US005704082A

United States Patent [19]

Smith

[11] Patent Number: 5,704,082

[45] Date of Patent: Jan. 6, 1998

[54] ANCHOR PIN FOR DUST RUFFLE

[76] Inventor: Catherine V. Smith, 12313 W. 18th Ave., Lakewood, Colo. 80215

[21] Appl. No.: 756,696

[22] Filed: Nov. 26, 1996

[51] Int. Cl.[6] ..... A47C 21/02; A47C 9/04

[52] U.S. Cl. ..... 5/493; 5/498; 411/457; 24/72.5; 24/710.5

[58] Field of Search ..... 5/493, 498, 922, 5/925; 24/72.5, 710.5, 711; 411/460, 461, 473, 457

[56] References Cited

U.S. PATENT DOCUMENTS

| | | | |
|---|---|---|---|
| 2,653,363 | 9/1953 | Lievsay, Jr. | 24/72.5 |
| 2,673,356 | 3/1954 | Fleming | 5/498 |
| 2,697,863 | 12/1954 | Moser | 24/711 X |
| 3,528,693 | 9/1970 | Pearson et al. | 24/710.5 X |
| 4,796,317 | 1/1989 | Kallman et al. | 5/493 |
| 4,955,813 | 9/1990 | Fochler | 411/457 |
| 5,086,571 | 2/1992 | Carlos | 5/493 |

FOREIGN PATENT DOCUMENTS

| | | | |
|---|---|---|---|
| 512376 | 9/1939 | United Kingdom | 24/72.5 |

*Primary Examiner*—Michael F. Trettel
*Attorney, Agent, or Firm*—Ramon L. Pizarro; Edwin H. Crabtree

[57] ABSTRACT

A system for decorating the border of a bed having a box spring, the system being used with the box spring. The system includes an anchor with a substantially flat body with an upper surface and an underside surface, the underside surface having an adhesive material. At least two prongs protrude from the underside surface of the body, so that the anchor may be used to secure sections of fabric to the box spring. A section of decorative fabric that includes a substantially flat section and a ruffled section, is also used with the system, so that the prongs on the anchor may be inserted through the substantially flat section of the decorative fabric and into the box spring, and so that the adhesive material on the underside surface of the substantially flat body may adhere to the flat section of the decorative fabric.

9 Claims, 2 Drawing Sheets

ANCHOR PIN FOR DUST RUFFLE

BACKGROUND OF THE INVENTION

1. Field of the Invention

This invention generally relates to the field of attachment devices and systems, and more particularly, but not by way of limitation, to a device and method for securing a dust ruffle to a box spring.

2. Discussion of Prior Art

The use of a dust ruffle about the perimeter of a bed is a well established practice. The dust ruffle acts as a decorative device and as a means for keeping dust out from under the bed. The dust ruffle is typically part of a large sheet section that is designed to fit over the box springs. The sheet section is bordered by the dust ruffle, so that once the sheet section is placed over the box springs the dust ruffle portion protrudes from between the box spring and the mattress, decorating the borders of the bed and keeping dust out from under the bed.

One of the most important shortcomings of the well known method for placing dust ruffles on a bed is that it requires that the mattress be removed from the box springs before the dust ruffle can be changed. This task can be overwhelming for some people. There have been attempts at simplifying the manner in which dust ruffles are attached to beds. One example of these devices includes U.S. Pat. No. 5,086,531 to Carlos. The Carlos device uses a section of support fabric which fits over the box spring and to which a dust ruffle is attached. This system, however, has limitations in that the dust ruffle must contain customized attachment means that mate with attachment means on the support fabric. Also, the use of a support fabric complicates the number of elements that a manufacturer must make in order to sell the system.

Thus there remains a need for a system for attaching dust ruffles to a box spring in a manner that does not require that the mattress be lifted from the box spring.

Still further, there remains a need for a device and system that allows traditional dust ruffles to be held firmly in place while the mattress is being place over the large fabric panel that covers the box springs in traditional dust ruffles.

Also, for the person who does not wish to use traditional dust ruffles, there remains a need for a system that allows firm, secure attachment of a decorative section of fabric in order to achieve the same aesthetic effects as having dust ruffle about the perimeter of a bed, without having to manufacture a dust ruffle with a large panel that covers the box springs.

There remains a need for a system for attaching a dust ruffle about the perimeter of a box spring without requiring special components. Thus there remains a need for a system that allows an individual to make dust ruffles without special equipment, other than, say, fabric and a sewing machine. There remains a need for a system that allows an individual to manufacture and install a dust ruffle having to incorporate special locking or mating devices and without the waste of including a large piece of fabric that fits between the mattress and box springs.

SUMMARY

It has been discovered that the above problems, which had been left unsolved by the known prior art, can be solved by providing an anchor pin for dust ruffles, the anchor pin including the following elements:

a) a substantially flat body having an upper surface and an underside surface;

b) at least two prongs protruding from the underside surface of the body; and c) an adhesive, tacky, gripping, or hook type material on the underside surface of the body.

It has been discovered that by combining the adhesive or gripping type material on the underside surface of the body, one produces a device that provides exceptional holding power, while having little or no tendency to tear the material being held. Thus, in a preferred embodiment of the device, the hook material typically used with the well known hook and loop material, such as the hook and loop material sold under the trademark Velcro. The use of hook material alone has been found to provide excellent gripping or adhesion power on fabric placed below the underside surface of the body of the device. Moreover, the hook material does not leave a sticky residue on the fabric on which the anchor is being used. Clearly, it is contemplated that chemical adhesive be used in place of the hook material on the underside surface of the body of the device. However, due to the ability of these materials to bleed on to the fabric, they are not preferred. Moreover, it is contemplated that a strip of loop material may also be added to the decorative, dust ruffle portion in order to provide a better grip between the bottom of the pin and the dust ruffle. However, since very good gripping has been achieved with the hook material alone. Therefore, while it is contemplated that the dust ruffle material may include loop material that mates with the hook material on the bottom surface of the anchor pin, the preferred embodiment uses only the hook type material to grab or adhere to the material of the dust ruffle. Clearly, a skilled artisan may place loop material on the flat surface of the dust ruffle in order to further strengthen the grip of the invention on the fabric of the dust ruffle. The loop material would be sown or glued to the flat section of the dust ruffle, whether it be the flat section of a traditional type dust ruffle, where a large sheet of material is used between the mattress and the box spring, or a simplified section of decorative material as taught herein. The flat section of material offering an area for attaching an anchor that is designed in accordance with the principles taught herein and being connected to decorative ruffled or pleated material which will be visible about the perimeter of the box spring.

In a preferred embodiment the body is generally longer than it is wide, and includes at least two prongs protruding from the underside surface, one near each end of the body. It has been found that by placing these prongs at approximately three-quarters to two inches apart from one another, and having a length of approximately from between one half of an inch and two inches in length, but preferably of one and one half inches in length, one may effectively provide significant gripping force on the dust ruffle to securely keep the dust ruffle in place, without damaging the fabric of the dust ruffle or damaging the filling or the fabric of the box spring.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
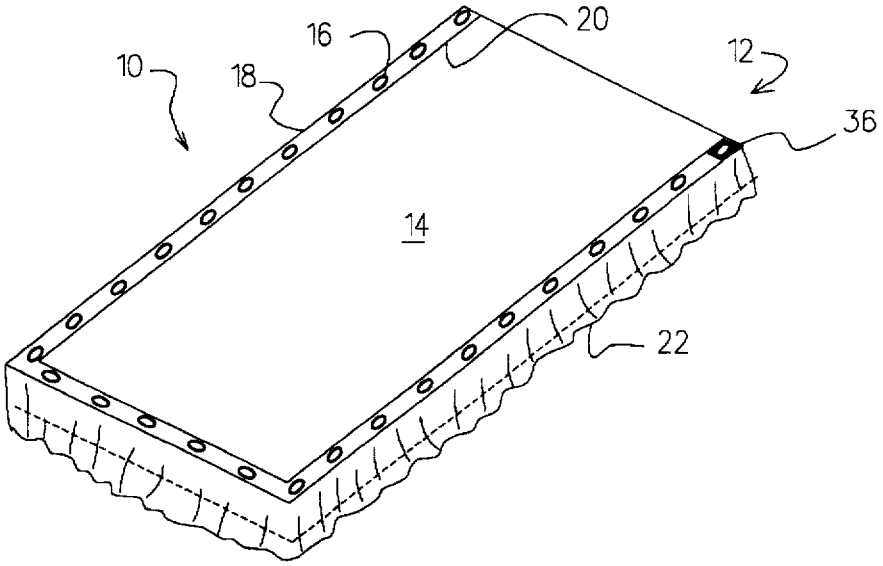
FIG. 1 is a perspective view of a box spring having a dust ruffle attached to the perimeter of the box spring by means of the system taught herein.

Turning now to FIG. 1 where a system 10 for decorating the border of a bed 12 having a box spring 14, the system 10 being used with the box spring 14. As has been illustrated in FIG. 1, the system 10 uses an anchor 16 to hold a section of decorative fabric 18, which includes a substantially flat section 20 and a ruffled section 22 that is attached to the flat section 20 and used to drape or cover the areas about the perimeter of the box spring 14. It is important to note that while the flat section 20 has been shown as being of a limited width, extending over only a small portion of the surface of the box spring 14. However it is clearly contemplated that the anchors 16 as taught herein may be used with traditional dust ruffles where the flat section 20 covers the entire surface of the box spring 14.

Figure 2:
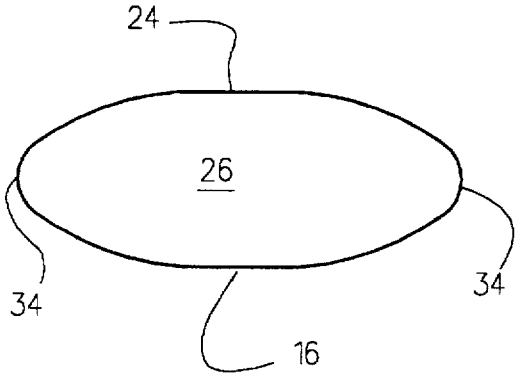
FIG. 2 is a top plan view of the upper surface of the body of the invention.
Figure 3:
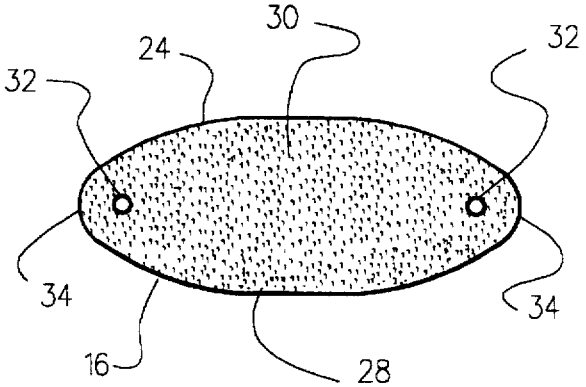
FIG. 3 is a bottom plan view of the invention and illustrating the hook material.
Figure 4:
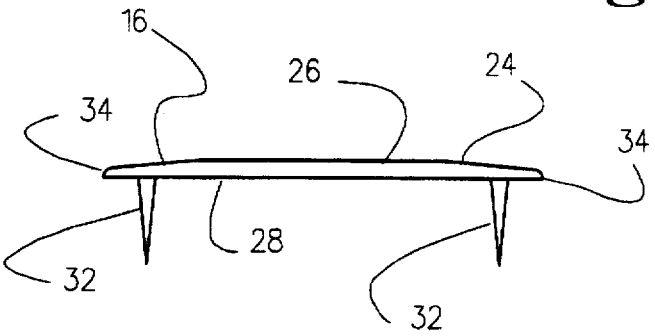
FIG. 4 is a side elevational view of the invention, showing the relationship of the prongs and the body.

Turning now to FIGS. 2-4 which illustrate that the anchors 16 includes a substantially flat body 24 with an upper surface 26 and an underside surface 28. It is preferred that the anchors 16 include a flat body 24, since the use of a body which is prominent or pronounced will tend to transfer forces that will have a tendency to torque or pull the device off of the box spring. The underside surface 28 includes an adhesive material 30. It is important to note that the term "adhesive" as used herein includes various means for attaching the underside surface 28 to fabric, these means include chemical adhesives such as well as mechanical securement means such as hook material found in hook and loop material. In a highly preferred embodiment this adhesive material 30 is the hook material that is commonly used as part of hook and loop mating sections, such as are sold under the trademark Velcro. However, it is contemplated that chemical adhesives may also be used; although these adhesives will have the disadvantage of possibly transferring some of the chemical adhesive on to the fabric.

Referring again to FIGS. 3 and 4, it can be seen that attached to the underside surface 28 of the flat body 24 are at least two prongs 32, which protrude from the underside surface 28. Since the anchors 16 are used to hold a flat section of fabric against a box spring 14, it has been found that the prongs 32 should be between approximately one third to one and one half inches in length, and preferably between one half and one and one quarter inches in length, and most preferably about one and one half inches in length. It has been found that this long length allows stable positioning of the anchor 16 on the box spring 14. Since box springs 14 typically include some sort of loose fill material 38, the long prongs 32 allow enough leverage to develop on the prong as the fill material 38 reacts against the prongs 32 when the shear load is imposed on the body 24. In other words, due to the low resistance of the fill material, one needs to include long prongs in order to develop enough holding strength in order to keep the anchor 16 in place.

Also shown on FIGS. 2 through 4 is the long shape of the body 24 of the anchor 16. The long shape provides the body 24 with a pair of opposite ends 34. As shown on FIGS. 3 and 4, the prongs 32 are preferably placed near the opposite ends 34. The long shape of the body 24 serves at least two purposes. This first purpose is to allow sufficient spacing between the prongs 32 so as to allow the development of good resistance to pivoting, of the fabric sustained, about one of the two prongs 32. Since the underside surface 28 of the body 24 includes an adhesive material 30 that is being used to secure relatively long sections of fabric, such as the flat section 20 on the decorative fabric 18, it is important that the spacing of the prongs 32 be relatively large, of about between one inch and one and one half inches, so that any forces that may tend to spin the anchor 16 about one of the prongs 32 can be properly resisted. Also, it should be noted that the body 24 is preferably made from a substantially rigid material such as steel, or other metals, and could be made from a plastic, particularly a fiber reinforced plastic, or combinations thereof.

Clearly, it is contemplated that in order to enhance the gripping of the hook adhesive material on the underside surface 28 of the flat body 24, one may add loop material 36 to the flat section 20 of the decorative fabric 18. As shown on FIG. 1, this may be done on the flat portion 20 of the decorative fabric 18. Clearly, it is contemplated that the flat portion 20, may extend to cover the entire surface of the box spring 14. However, this would incorporate the traditional style of dust ruffle designs which would not take full advantage of the innovations taught therein. For example, by using the anchors 16 with a dust ruffle of traditional design one would have to remove the mattress from the box spring in order to change the dust ruffle. Whereas, by using the preferred embodiment taught herein, the ruffled decorative fabric may be changed without removing the mattress by simply attaching the anchors 16 through the flat portion 20 of the decorative fabric 18. Therefore, it is important to point out that as illustrated in FIG. 1A the anchors 16 taught herein may be used with traditional dust ruffles as well as with sections of decorative fabric 18 as taught herein.

Figure 5:
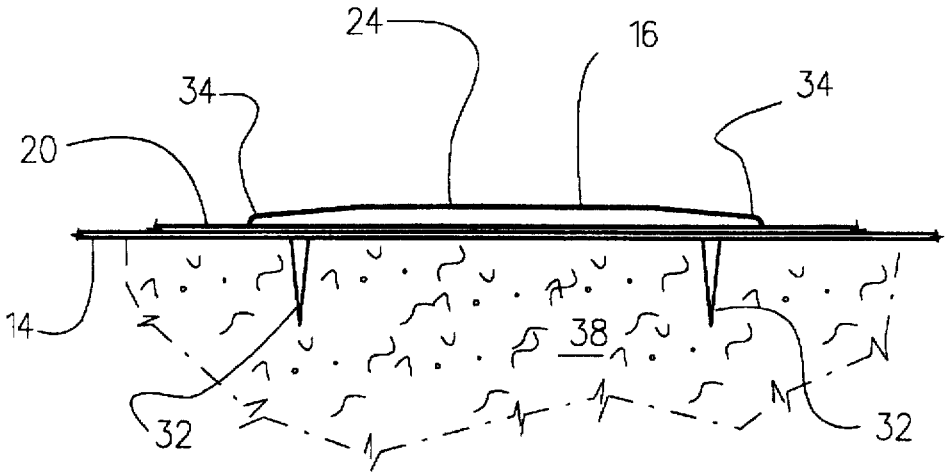
FIG. 5 is a side view of the invention as used to keep a section of fabric in place.
Figure 6:
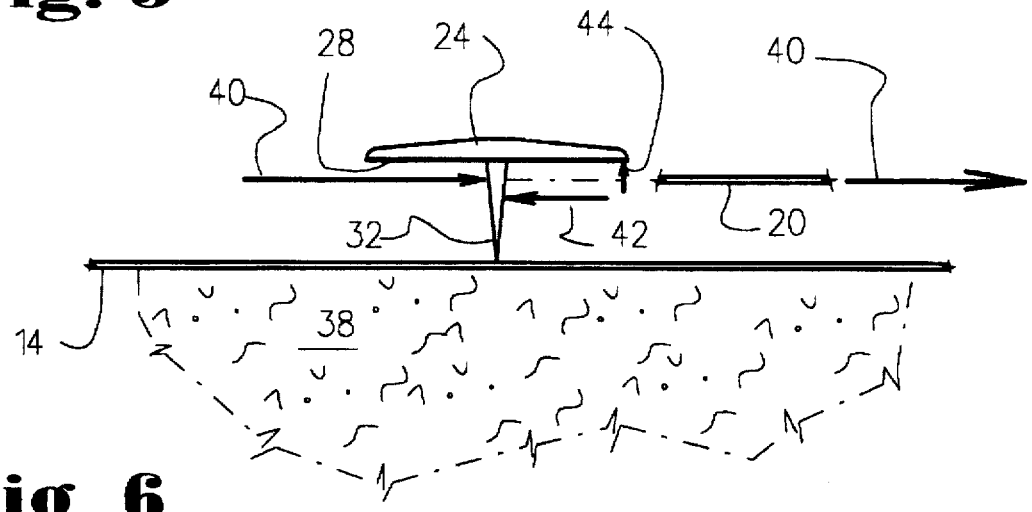
FIG. 6 is an end view of the embodiment of the invention illustrated in FIG. 5, and illustrating the reactions and forces on a prong if the adhesive or hook material is not used on the underside surface of the invention.
Figure 7:
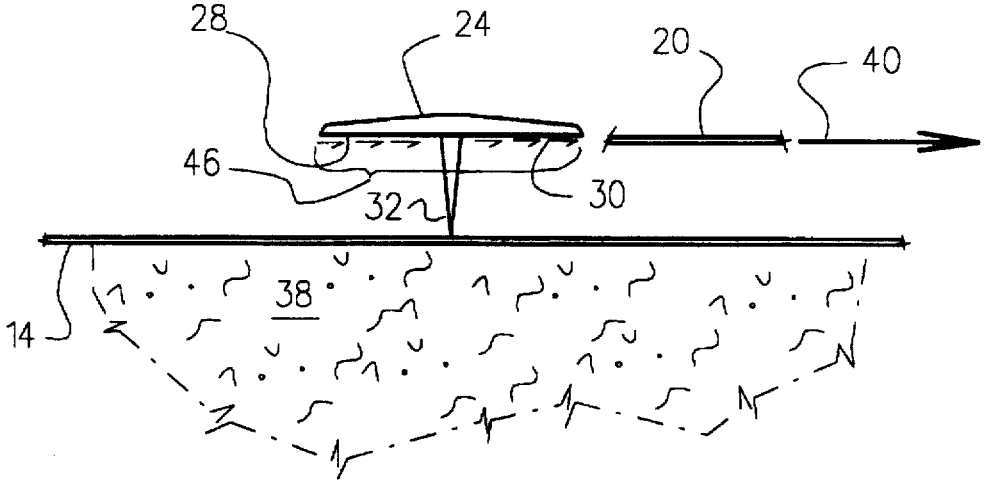
FIG. 7 is an end view of the embodiment of the invention illustrated in FIG. 5, and illustrating the reactions and forces on a prong and underside surface of the body when the adhesive or hook material is used on the underside surface of the invention.

Thus, details of the use of the instant invention is shown on FIGS. 5 through 7, where the flat section 20 has been shown against the box springs 14, and the prongs 32 have been shown inserted into the box springs and into the fill material 38 within the box springs 14.

Referring now to FIGS. 6 and 7, where the effect of the addition of the adhesive material 30 on the underside has been illustrated. In FIG. 6, the forces and reactions resulting from not using, or the absence of, the adhesive material 30 on the underside surface 28. In FIG. 6 it is shown that a pulling force, indicated by numeral 40, imposed on the anchor 24 by the flat section 20 of the decorative fabric 18 will be reacted on the prong 32. The reaction on prong 32 will also be reacted by the fill material 38, and shown as vector arrow 42, causing the body 24 and the anchor 16 to begin to rotate. This tendency to rotate has to be reacted by a vertical force 44. However, due to softness of the fill material 38, the force 44 may not be sufficient as to keep the body 24 from rotating, which will in turn result in a pulling out of the entire anchor 16 from the box spring 14.

The reactions due to the addition of the adhesive material 30 has been illustrated on FIG. 7, where the reaction to the force 40 from the flat section 20 of the decorative fabric 18 has been shown. By incorporating adhesive material 30 one allows the anchor 16 to react to and accept the force 40 by means of a running shear load 46. Since the shear load 46 is distributed on both sides of the underside surface 28 of the body 24, the tendency to rotate or flip the body 24 and, hence, the anchor 16 is greatly diminished. This will in turn ensure that the anchor 16 stays in place.

Still further, it will be understood that in addition to the diminution in the tendency to pull the anchor 16 out, the use of the adhesive material 30 will also minimize the likelihood of tearing the decorative fabric 18, protecting the flat section 20 of the decorative fabric 18. Thus, the disclosed invention produces unexpected new, useful, synergistic effects heretofore unachieveable with devices in the known prior art.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. An anchor for securing a section of fabric against the anchor and against a surface of an object, the anchor comprising:

a body having an upper surface and an underside surface, the underside surface having an adhesive material; and at least two spaced apart prongs protruding from the underside surface of the body, so that the anchor may be inserted through the fabric and into the surface, and so that the adhesive material on the underside surface of the substantially flat body may uniformly adhere to the fabric so that a force on the fabric may first be transferred to the underside of the body before being reacted by the prongs.

2. An anchor according to claim 1 and wherein said adhesive material comprises hook material.

3. An anchor according to claim 2 and wherein said body comprises a substantially flat section of substantially rigid material, the body further having a generally elongated shape having opposite ends.

4. An anchor according to claim 3 and wherein said prongs are placed near the ends of said body.

5. A system for decorating a bed having a box spring, the system being used with the box spring, the system comprising:

an anchor comprising:

a substantially flat body having an upper surface and a underside surface, the underside surface having an adhesive material;

at least two prongs protruding from the underside surface of the body;

a section of decorative fabric comprising a substantially flat section and a ruffled section, so that the prongs on the anchor may be inserted through the substantially flat section of the decorative fabric and into the box spring, and so that the adhesive material on the underside surface of the substantially flat body may adhere to the flat section of the decorative fabric.

6. A system according to claim 5 and wherein said adhesive material comprises hook material.

7. A system according to claim 6 and wherein said body comprises a substantially flat section of substantially rigid material, the body further having a generally elongated shape having opposite ends.

8. A system according to claim 7 and wherein said prongs are placed near the ends of said body.

9. A system according to claim 8 and further comprising loop material on the flat section of said section of decorative fabric.

* * * * *